US011603229B2

(12) United States Patent
Hodgetts et al.

(10) Patent No.: US 11,603,229 B2
(45) Date of Patent: Mar. 14, 2023

(54) BOX WITH CHAMFERED CORNERS

(71) Applicant: The Procter & Gamble Company, Cincinnati, OH (US)

(72) Inventors: Jonathan Hodgetts, Schwalbach am Taunus (DE); Carsten F. Neumann, Birkenwerder (DE); Volker Quaas, Empfertshausen (DE); Timo Teubert, Munningen (DE); Jutta Scherban, Karlsdorf-Neuthard (DE)

(73) Assignee: The Procter & Gamble Company, Cincinnati, OH (US)

( * ) Notice: Subject to any disclaimer, the term of this patent is extended or adjusted under 35 U.S.C. 154(b) by 96 days.

(21) Appl. No.: 17/359,988

(22) Filed: Jun. 28, 2021

(65) Prior Publication Data

US 2021/0403195 A1 Dec. 30, 2021

(30) Foreign Application Priority Data

Jun. 29, 2020 (EP) ..... 20182846

(51) Int. Cl.
*B65D 5/02* (2006.01)
*B65D 5/42* (2006.01)
*B65D 5/468* (2006.01)

(52) U.S. Cl.
CPC ..... *B65D 5/0236* (2013.01); *B65D 5/0209* (2013.01); *B65D 5/4266* (2013.01); *B65D 5/4608* (2013.01)

(58) Field of Classification Search
CPC .... B65D 5/029; B65D 5/0209; B65D 5/0218; B65D 5/0227; B65D 5/0236; B65D 5/4266; B65D 5/4608
USPC ..... 229/109, 110, 164, 918
See application file for complete search history.

(56) References Cited

U.S. PATENT DOCUMENTS 2,114,052 A * 4/1938 Kincade, Jr. ..... B65D 5/02 206/427
2,967,655 A * 1/1961 Seger, Jr. ..... B65D 5/0227 229/125
4,850,527 A * 7/1989 Church ..... B65D 5/4279 229/920
5,147,271 A * 9/1992 Bacques ..... B65D 5/029 493/143
5,755,377 A * 5/1998 Durand ..... B65D 5/10 229/110

(Continued)

FOREIGN PATENT DOCUMENTS

EP 0239507 5/1989
FR 2594095 A1 8/1987

(Continued)

OTHER PUBLICATIONS

PCT Search Report and Written Opinion for PCT/US2021/039320 dated Sep. 23, 2021, 12 pages.
European Patent Office Search Report, dated Dec. 17, 2020.

*Primary Examiner* — Nathan J Newhouse
*Assistant Examiner* — Phillip D Schmidt
(74) *Attorney, Agent, or Firm* — Christian M. Best

(57) ABSTRACT

The present disclosure relates to a box having two chamfered corners. The box has a front and a back panel, two side panels and two corner panels. The box also has a top panel and a bottom panel. The top panel has two major flaps and two minor flaps with unique configuration which enables easy folding, closing and opening of the box.

17 Claims, 8 Drawing Sheets

(56) References Cited

U.S. PATENT DOCUMENTS

| | | | | |
|---|---|---|---|---|
| 6,079,616 | A * | 6/2000 | Chinks | B65D 5/029 229/101 |
| 7,090,115 | B2 * | 8/2006 | Pierce | B65D 5/029 229/109 |
| 7,886,958 | B2 * | 2/2011 | Smith | B65D 5/3621 229/117 |
| 10,336,501 | B2 * | 7/2019 | Smith | B65D 5/106 |
| 2006/0273142 | A1 * | 12/2006 | Pierce | B65D 5/029 229/109 |
| 2010/0001054 | A1 | 1/2010 | Brittain | |
| 2011/0111938 | A1 * | 5/2011 | Smith | B31B 50/81 493/162 |
| 2016/0106248 | A1 | 4/2016 | Petersen et al. | |
| 2016/0137333 | A1 * | 5/2016 | Brundage | B65D 5/001 229/5.5 |

FOREIGN PATENT DOCUMENTS

| | | | | |
|---|---|---|---|---|
| GB | 2596532 | A * | 1/2022 | B65D 5/20 |
| WO | WO-2015034856 | A1 * | 3/2015 | B65D 5/4608 |

* cited by examiner

BOX WITH CHAMFERED CORNERS

CROSS REFERENCE TO RELATED APPLICATION

This application claims priority under 35 U.S.C. § 119 to European Patent Application Serial No. 20182846.4, filed on Jun. 29, 2020, the entire disclosure of which is hereby incorporated by reference.

FIELD

The present disclosure relates to a box having two chamfered corners.

BACKGROUND

Boxes are widely used to package all kinds of articles, inter alia for packaging and storing absorbent articles for personal hygiene, such as diapers, pants or feminine hygiene articles. Boxes containing absorbent articles are typically formed of a foldable sheet material, typically cardboard, which can be converted into the box. The boxes may be relatively small and contain individual, non-bundled absorbent articles, e.g. sanitary napkins or pantyliners. Alternatively, the boxes may be larger and contain, e.g. two, three or more bundles of absorbent articles, such as diapers or pants, with each bundle being provided within a flexible packaging, such that the boxes contain several of such flexible packages, each filled with a number of absorbent articles.

For storage and transport, the boxes are typically stacked and piled up on one another. To this end, the boxes have to be sufficiently stable to withstand deformation and, worst case, even collapse upon stacking. On the other hand, the material of which the boxes are made, typically cardboard, or corrugated cardboard, is desired to be as thin as possible due to cost and weight.

Moreover, especially for larger boxes, such as boxes which get filled with several flexible packages, each containing a number of absorbent articles, a certain amount of manual work (i.e. not done by machines) is still required. Therefore, there is a need for a box which can be easily, quickly and precisely folded and erected from a continuous blank of foldable sheet material.

SUMMARY

The present invention provides a box with two chamfered edges. The box comprises a front panel and a back panel, a first and a second side panel, and a first and a second corner panel.

The first corner panel adjoins the front panel and the first side panel and extends intermediate the front panel and first side panel. The second corner panel adjoins the back panel and the second side panel and extends intermediate the back panel and second side panel.

A first upper major flap is hingedly adjoined to the front panel along a first upper fold line, and a second upper major flap hingedly adjoining to the back panel along a second upper fold line. A first upper minor flap is hingedly adjoined to the first side panel along a third upper fold line, and a second upper minor flap is hingedly adjoined to the second side panel along a fourth upper fold line. The first and second upper major flap and the first and second upper minor flaps, in conjunction, form a top panel of the box.

A first lower major flap is hingedly adjoined to the front panel along a first lower fold line, and a second lower major flap is hingedly adjoined to the back panel along a second lower fold line. A first lower minor flap is hingedly adjoined to the first side panel along a third lower fold line, and a second lower minor flap is hingedly adjoined to the second side panel along a fourth lower fold line. The first and second lower major flap and the first and second lower minor flaps, in conjunction, form a bottom panel of the box.

The first upper minor flap comprises a first side edge and a second side edge, the first side edge being overlapped by the first upper major flap when the top panel of the box is closed, and the second side edge being overlapped by the second upper major flap when the top panel of the box is closed.

The first side edge of the first upper minor flap comprises a first section and a second section. The first section is provided in between the third upper fold line and the second section.

In the first upper minor flap, a first angle ($\alpha$1) of between 120° and 150°, preferably between 130° and 140°, more preferably between 134° and 136°, and even more preferably 135°, is formed between the third upper fold line and the first section of the first side edge.

The first section of the first upper minor flap abuts the first corner panel when the box is in its erected, closed configuration, and the second section of the first upper minor flap abuts the first upper fold line when the box is in its erected, closed configuration.

The second upper minor flap comprises a first side edge and a second side edge, the first side edge being overlapped by the second upper major flap when the top panel of the box is closed, and the second side edge being overlapped by the first upper major flap when the top panel of the box is closed.

The first side edge of the second upper minor flap comprises a first section and a second section. The first section is provided in between the fourth upper fold line and the second section.

In the second upper minor flap, a second angle ($\alpha$2) of between 120° and 150°, preferably between 130° and 140°, more preferably between 134° and 136°, and even more preferably 135°, is formed between the fourth upper fold line and the first section of the first side edge.

The first section of the second upper minor flap abuts the second corner panel when the box is in its erected, closed configuration, and the second section of the second upper minor flap abuts the second upper fold line when the box is in its erected, closed configuration.

The first upper major flap comprises a first side edge and a second side edge, the first side edge overlapping the second upper minor flap when the box is closed, and the second side edge overlapping the first upper minor flap when the box is closed. The first upper major flap further comprises an end edge extending between the first and second side edges.

The second side edge of the first upper major flap comprises a first section and a second section. The first section is provided in between the first upper fold line and the second section.

In the first upper major flap, a third angle ($\alpha$3) of between 120° and 150°, preferably between 130° and 140°, more preferably between 134° and 136°, and even more preferably, is formed between the first upper fold line and the first section of the second side edge. The first section of the first upper major flap abuts the first corner panel when the box is in its erected, closed configuration.

The second upper major flap comprises a first side edge and a second side edge. The first side edge overlaps the first upper minor flap when the box is closed, and the second side edge overlaps the second upper minor flap when the box is closed. The second upper major flap further comprises an end edge extending between the first and second side edges.

The second side edge of the second upper major flap comprises a first section and a second section. The first section is provided in between the second upper fold line and the second section.

In the second upper major flap, a fourth angle ($\alpha$4) of between 120° and 150°, preferably between 130° and 140°, more preferably between 134° and 136°, and even more preferably, is formed between the second upper fold line and the first section of the second side edge.

The first section of the second upper major flap abuts the second corner panel when the box is in its erected, closed configuration.

The sum of the first angle ($\alpha$1) and the third angle ($\alpha$3) is between 240° and 300°, preferably between 260° and 280°, more preferably 270°, and the sum of the second angle ($\alpha$2) and the fourth angle ($\alpha$4) is between 240° and 300°, preferably between 260° and 280°, more preferably 270°.

In the box, a corner is formed where the second side edge of the first upper major flap and the end edge of the first upper major flap coincide. When the box is in its erected, closed configuration, this corner also coincides with the first side edge of the second upper major flap.

In the box, a corner is formed where the first side edge of the first upper major flap coincides with the end edge of the first upper major flap. This corner is on the top panel and spaced inwardly away from the fourth upper fold line by at least 10 mm when the box is in its erected, closed configuration.

Moreover, in the box a corner is formed where the first side edge of the second upper major flap coincides with the end edge of the second upper major flap. This corner is on the top panel and spaced inwardly away from the third upper fold line by at least 10 mm when the box is in its erected, closed configuration.

In the box, a corner may be formed where the second side edge of the first upper major flap and the end edge of the first upper major flap coincide. This the corner may also coincide with the corner that is formed where the first side edge of the second upper major flap coincides with the end edge of the second upper major flap when the box is in its erected, closed configuration.

In the box, a further corner may be formed where the second side edge of the second upper major flap and the end edge of the second upper major flap coincide. This corner may also coincide with the corner that is formed where the first side edge of the first upper major flap coincides with the end edge of the first upper major flap when the box is in its erected, closed configuration.

Likewise, the first side edge of the second upper major flap may comprise a third section and a fourth section. The third section may be provided in between the second upper fold line and the fourth section. The third section may be perpendicular to the second upper fold line. The fourth section may transition such that the corner, where the first side edge and the end edge coincide, coincides with the second section of the first side edge of the first upper major flap when the box is in its erected, closed configuration.

In this configuration the upper major flaps cannot be easily folded or damaged when the box is closed, thereby contributing to the integrity of the closed box. Also, such configuration provides a box with an appearance of higher quality.

DETAILED DESCRIPTION

Figure 1:
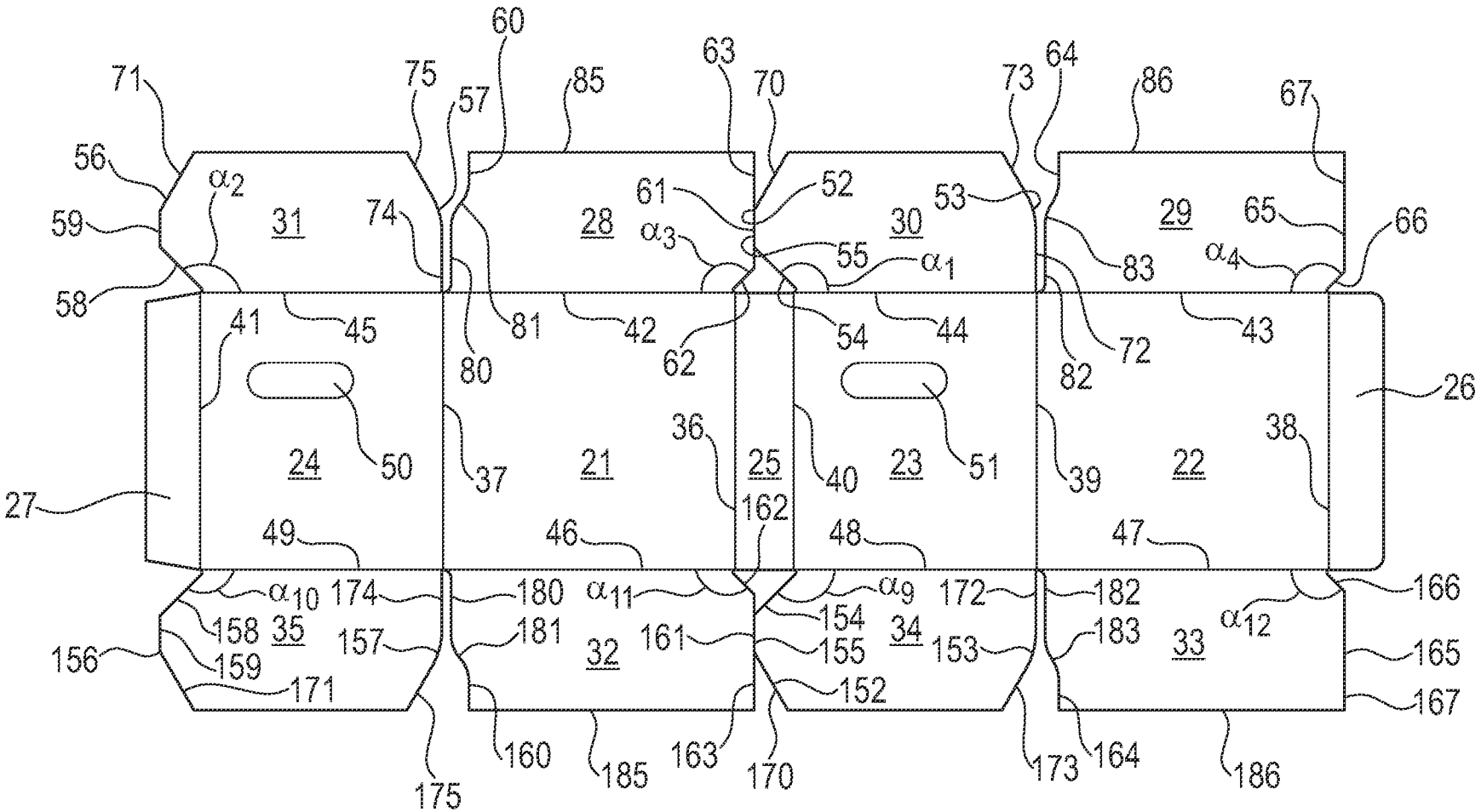
FIG. 1 shows an embodiment of the box of the present invention in its unfolded and non-erected configuration (i.e. as a continuous blank of foldable sheet material that can be converted into a box).
Figure 2:
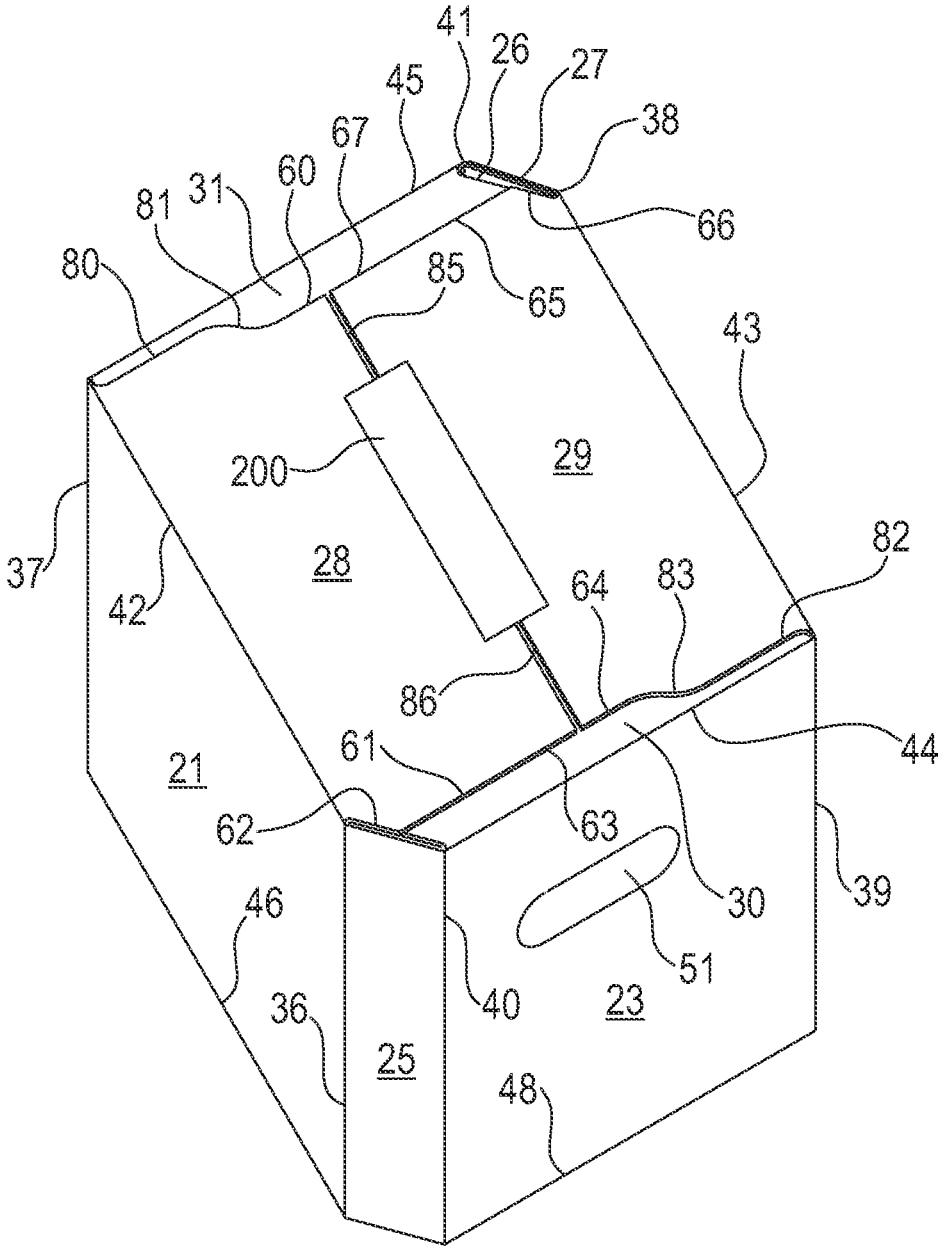
FIG. 2 shows the box of FIG. 1 in its erected, closed configuration, sealed with a tape.
Figure 3:
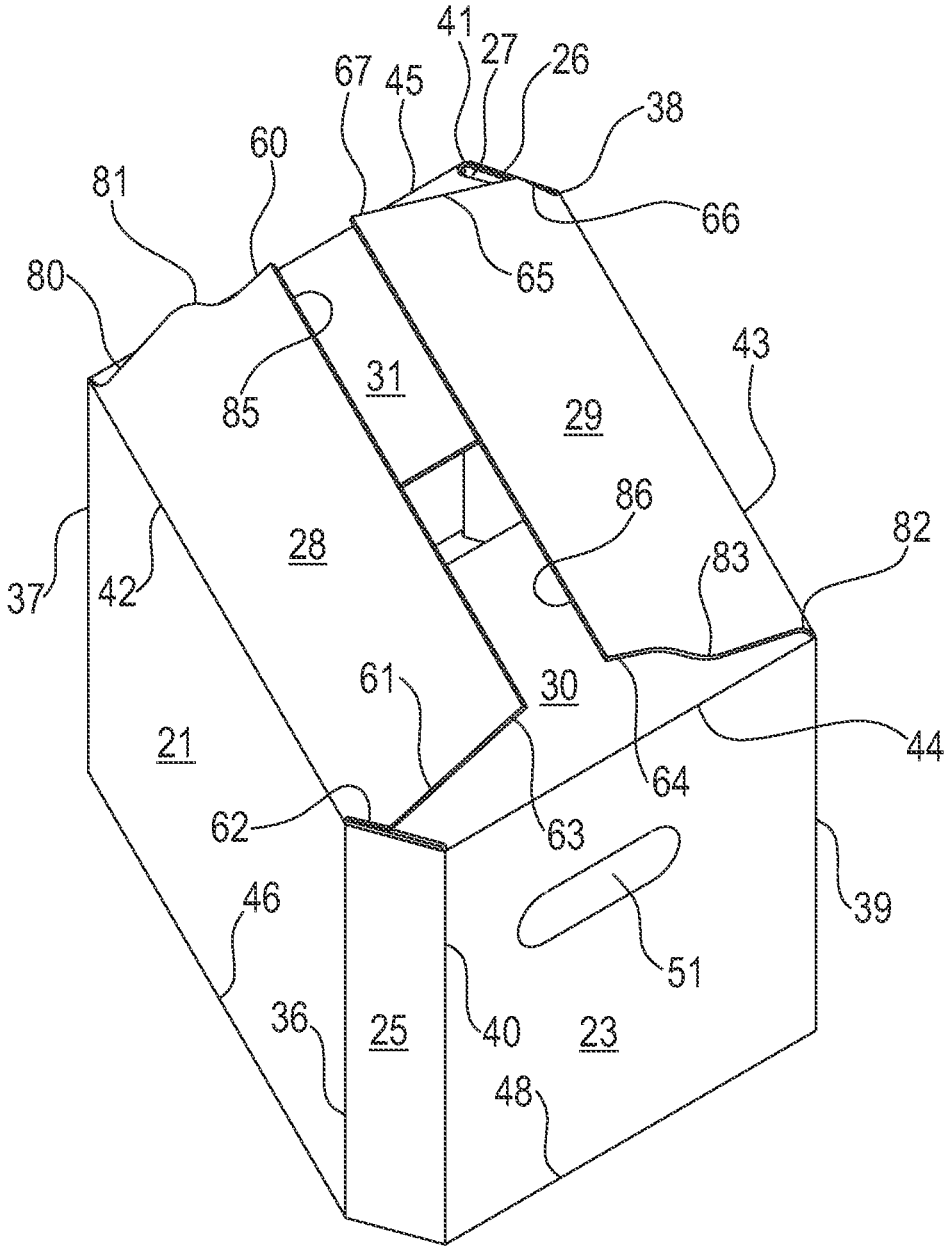
FIG. 3 shows the box of FIG. 2 with the top panel being partly open.
Figure 4:
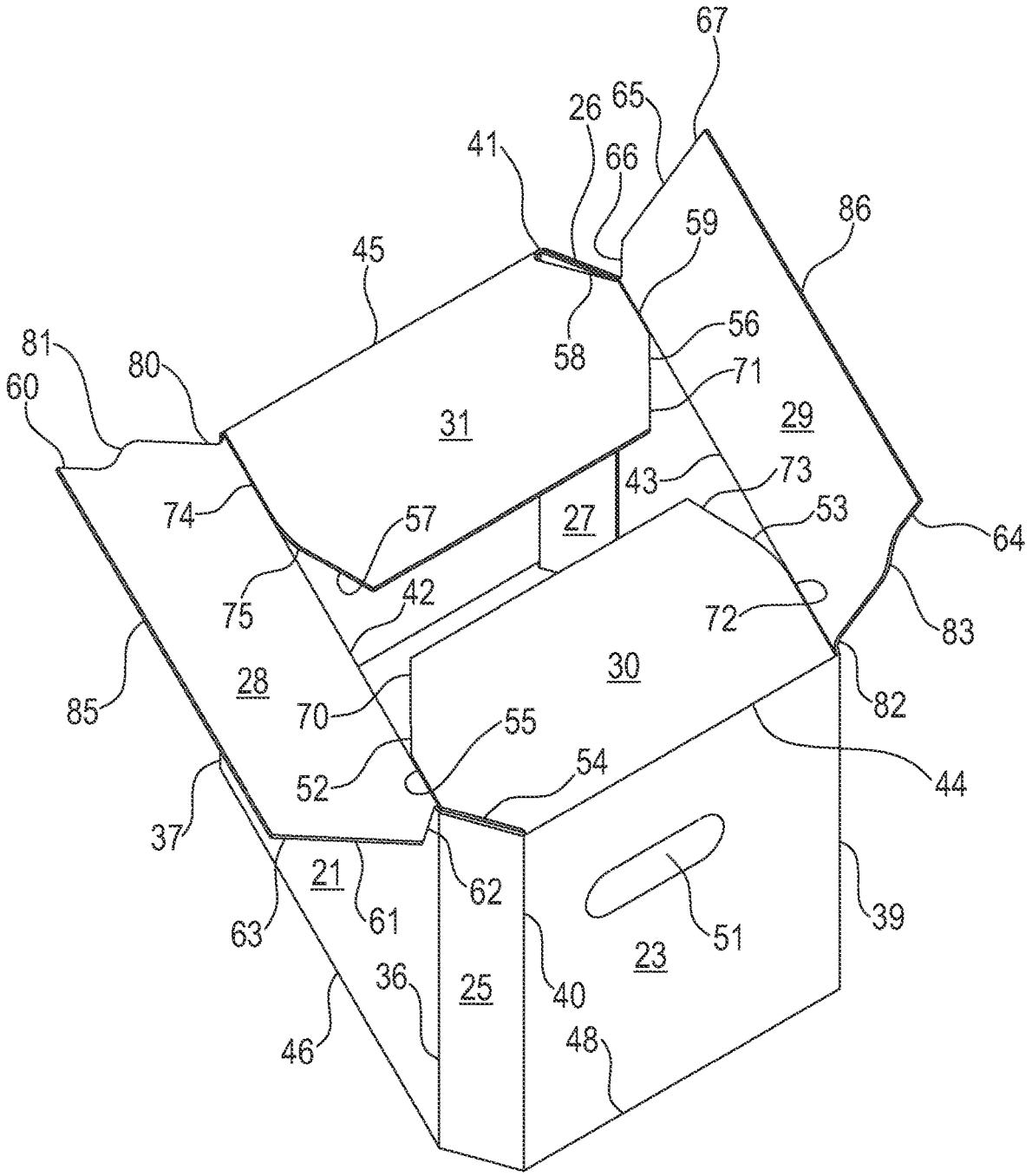
FIG. 4 shows the box of FIGS. 2 and 3 further opened, i.e. the first and second upper major flaps are folded outwardly while the first and second upper minor flaps are not.
Figure 5:
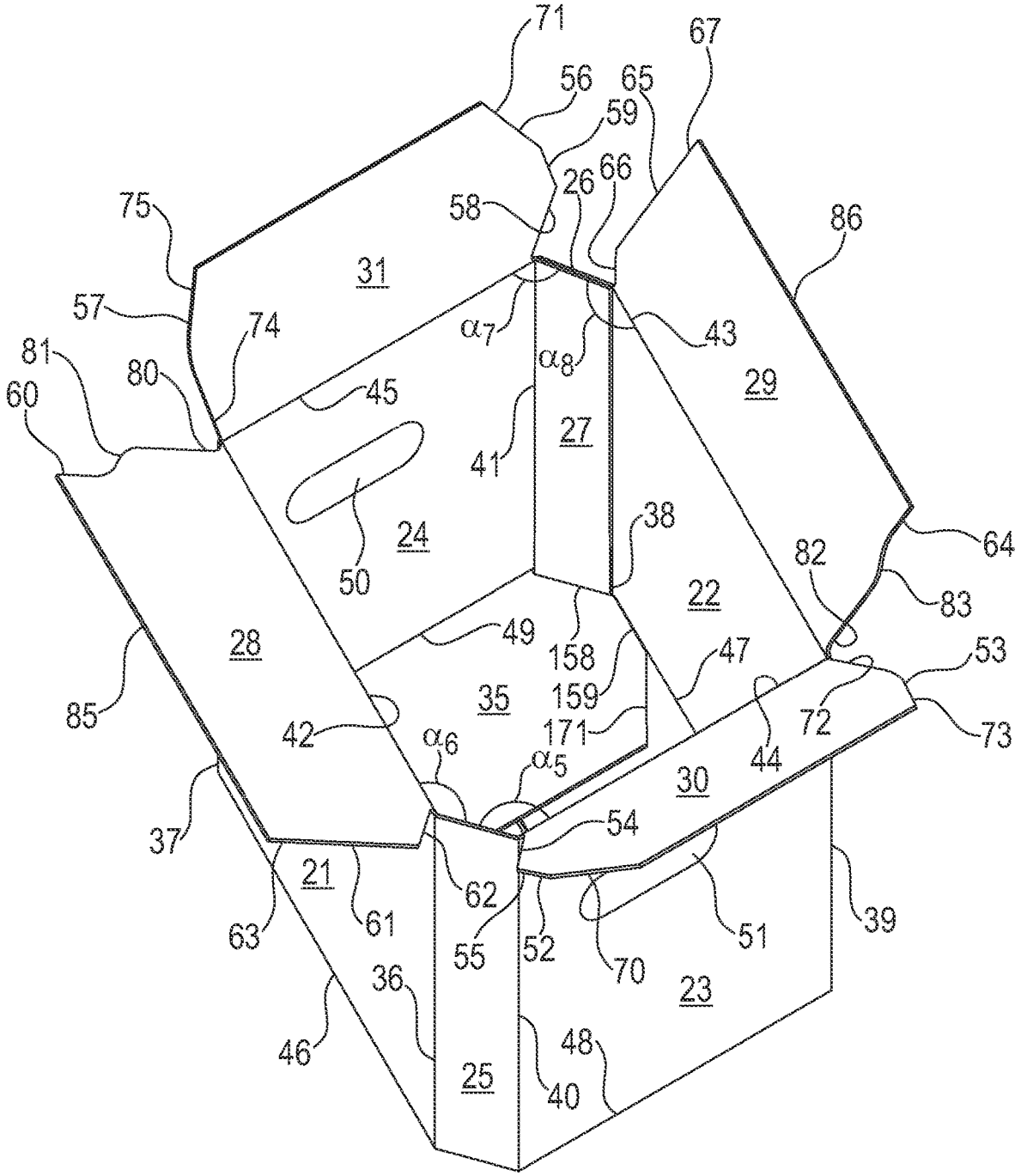
FIG. 5 shows the box of FIGS. 2 to 4 with the top panel fully opened.
Figure 6:
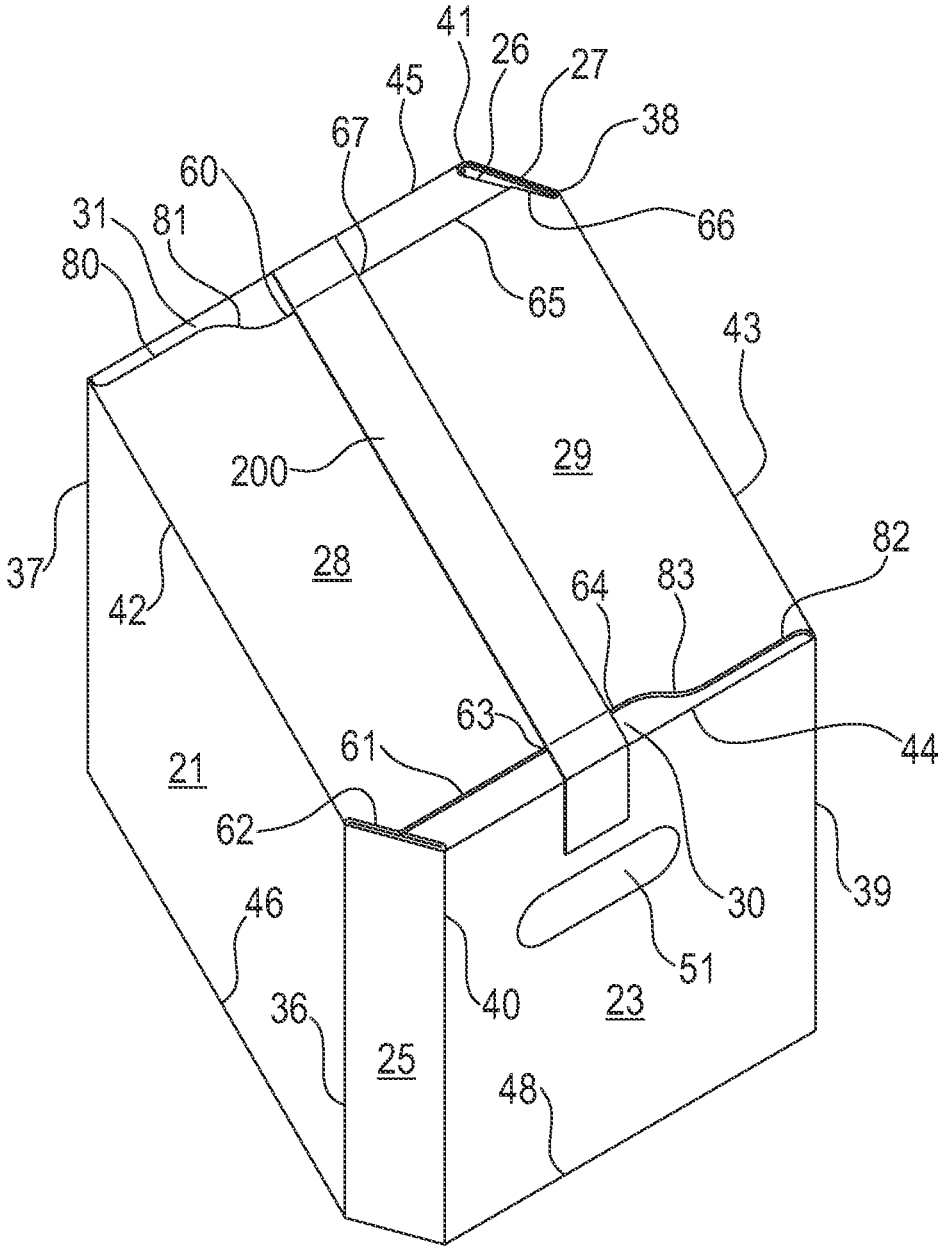
FIG. 6 shows the box of FIG. 2 in a closed configuration sealed with a longer tape than the one shown in FIG. 2.
Figure 7:
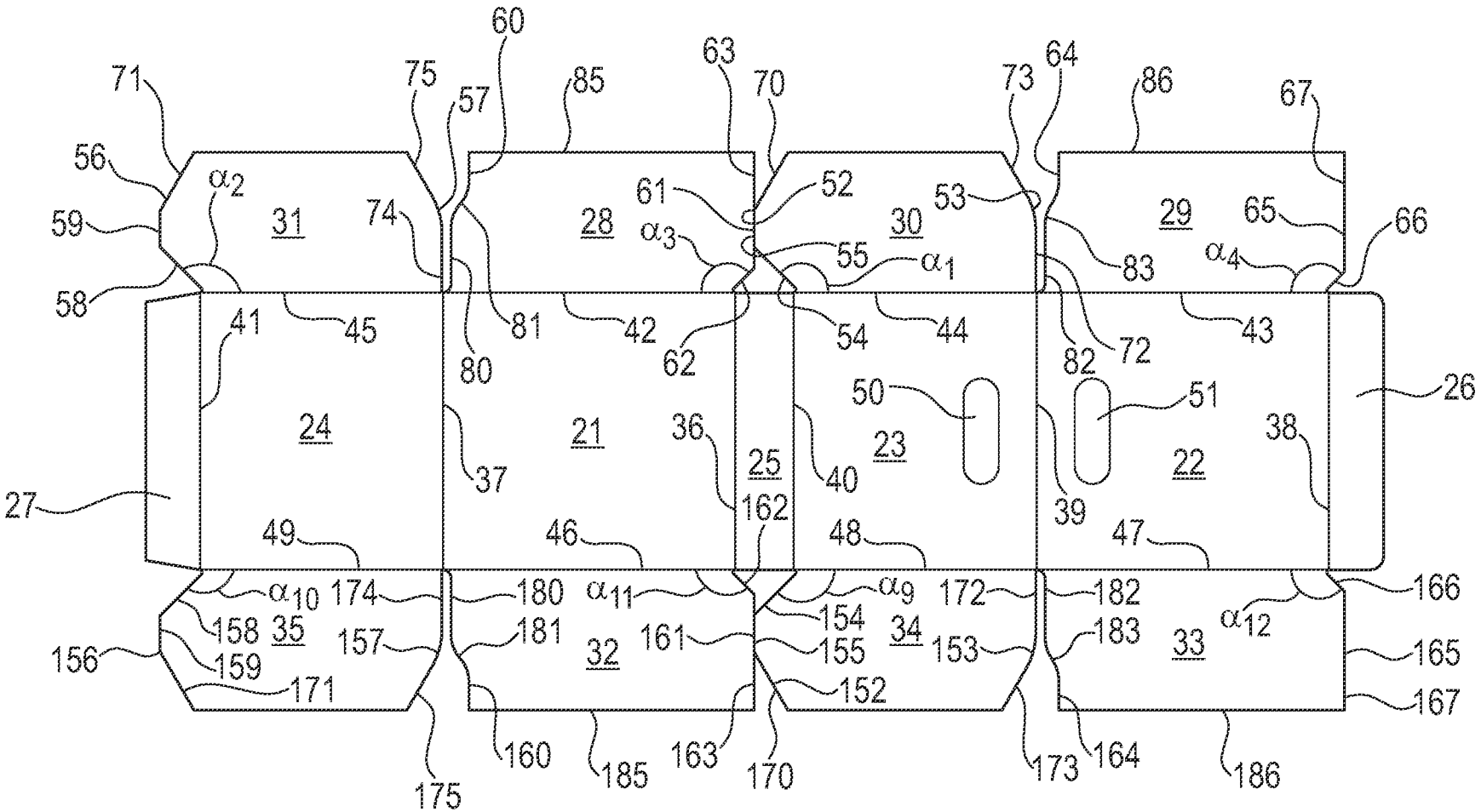
FIG. 7 shows a box having different cut-out sections than those shown in FIG. 1, to enable gripping the box.

A box with two chamfered edges is provided. An exemplary box is illustrated in FIGS. 1 and 7 in its unfolded and non-erected configuration. FIGS. 2 to 6 and FIG. 8 show the box in its erected configuration, either closed (FIGS. 2, 6 and 7), or with the top panel partly or fully opened (FIGS. 3 to 5). The box 20 comprises a front panel 2 and a back panel 22, a first and a second side panel 23, 24, and a first and a second corner panel 25, 26. The first corner panel 25 adjoins the front panel 21 and the first side panel 23 and extends intermediate the front panel 21 and first side panel 23. The second corner panel 26 adjoins the back panel 22 and the second side panel 24 and extends intermediate the back panel 22 and second side panel. The box may only have two corner panels (namely the first and second corner panel). Hence, for the other two corners of the box, the first side panel may be directly adjoined to the back panel and the second side panel may be directly adjoined to the front panel.

The box further comprises a first upper major flap 28 that is hingedly adjoined to the front panel 21 along a first upper fold line 42, and a second upper major flap 29 hingedly adjoined to the back panel 22 along a second upper fold line 43. A first upper minor flap 30 is hingedly adjoined to the first side panel 23 along a third upper fold line 44, and a second upper minor flap 31 is hingedly adjoined to the second side panel 24 along a fourth upper fold line. The first and second upper major flap 28, 29 and the first and second upper minor flaps 30, 31, in conjunction, form a top panel of the box.

A first lower major flap 32 is hingedly adjoined to the front panel 21 along a first lower fold line 46, and a second lower major flap 29 is hingedly adjoined to the back panel 22 along a second lower fold line 47. A first lower minor flap 30 is hingedly adjoined to the first side panel 23 along a third lower fold line 48, and a second lower minor flap 31 hingedly adjoined to the second side panel 24 along a fourth lower fold line 49. The first and second lower major flap 28, 29 and the first and second lower minor flaps 30, 31, in conjunction, form a bottom panel of the box. For the avoidance of doubt, the terms top panel and bottom panel, as used herein, are not meant to be limiting in the sense that the box may also be used upside down, i.e. when the box is place, e.g., on a table, the top panel is the panel that is in direct contact with a table.

The first upper minor flap 30 comprises a first side edge 52 and a second side edge 53, the first side edge 52 being overlapped by the first upper major flap 28 when the top panel of the box is closed, and the second side edge 53 being overlapped by the second upper major flap 29 when top panel of the box is closed.

The first side edge 52 of the first upper minor flap 30 comprises a first section 54 and a second section 55. The first section 54 is provided in between the third upper fold line 44 and the second section 55. The first section is preferably a straight line. The second section is preferably a straight line.

In the first upper minor flap 30, a first angle ($\alpha$1) (shown in FIG. 1) of between 120° and 150°, preferably between 130° and 140°, more preferably between 134° and 136°, and even more preferably 135° is formed between the third upper fold line 44 and the first section 54 of the first side edge 52.

The first section 54 of the first upper minor flap 30 abuts the first corner panel 25 when the box is in its erected, closed configuration, and the second section 55 of the first upper minor flap 30 abuts the first upper fold line 42 when the box is in its erected, closed configuration.

The second upper minor flap 31 comprises a first side edge 56 and a second side edge 57. The first side edge 56 is overlapped by the second upper major flap 29 when the top panel of the box is closed, and the second side edge 57 is overlapped by the first upper major flap 28 when the top panel of the box is closed.

The first side edge 56 of the second upper minor flap 31 comprises a first section 58 and a second section 59. The first section 58 is provided in between the fourth upper fold line 45 and the second section 59. The first section is preferably a straight line. The second section is preferably a straight line.

In the second upper minor flap 31, a second angle ($\alpha$2) (shown in FIG. 1) of between 120° and 150°, preferably between 130° and 140°, more preferably between 134° and 136°, and even more preferably 135° is formed between the fourth upper fold line 45 and the first section 58 of the first side edge 56.

The first section 58 of the second upper minor flap 31 abuts the second corner panel 26 when the box is in its erected, closed configuration, and the second section 59 of the second upper minor flap 31 abuts the second upper fold line 43 when the box is in its erected, closed configuration.

Having the first section 54 of the first upper minor flap 30 abut the first corner panel 25, and the second section 55 of the first upper minor flap 30 abut the first upper fold line 42 when the box is in its erected, closed configuration, and also having the first section 58 of the second upper minor flap 31 abutting the second corner panel 26, and the second section 59 of the second upper minor flap 31 abutting the second upper fold line 43 when the box is in its erected, closed configuration, a box with good stability is provided. Thus, the form of the box cannot be easily deformed, because the position of the front and back panel, the side panels and the corner panels relative to each other cannot be easily shifted. This is obtained without providing any additional flaps to the top panel which would need to be folded and processed in addition to the major and minor flaps.

The first upper major flap 28 comprises a first side edge 60 and a second side edge 61. The first side edge 60 overlaps the second upper minor flap 31 when the top panel of the box is closed, and the second side edge 61 overlaps the first upper minor flap 30 when the top panel of the box is closed. The first upper major flap 28 further comprises an end edge 85 extending between the first and second side edges 60, 61.

The second side edge 61 of the first upper major flap 28 comprises a first section 62 and a second section 63. The first section 62 is provided in between the first upper fold line 42 and the second section 63. The first section is preferably a straight line.

In the first upper major flap 28, a third angle ($\alpha$3) (shown in FIG. 1) of between 120° and 150°, preferably between 130° and 140°, more preferably between 134° and 136° and even more preferably 135° is formed between the first upper fold line 42 and the first section 62 of the second side edge 61.

The first section 62 of the first upper major flap 28 abuts the first corner panel 25 when the box is in its erected, closed configuration.

The second upper major flap 29 comprises a first side edge 64 and a second side edge 65. The first side edge 64 overlaps the first upper minor flap 30 when the top panel of the box is closed, and the second side edge 65 overlaps the second upper minor flap 31 when the top panel of the box is closed. The second upper major flap 29 further comprises an end edge 86 extending between the first and second side edges 64, 65.

The second side edge 65 of the second upper major flap 29 comprises a first section 66 and a second section 67. The first section 66 is provided in between the second upper fold line 43 and the second section 67. The second section is preferably a straight line.

In the second upper major flap 29, a fourth angle ($\alpha$4) (shown in FIG. 1) of between 120° and 150°, preferably between 130° and 140°, more preferably between 134° and 136, and even more preferably 135° is formed between the second upper fold line 43 and the first section 65 of the second side edge 65.

The first section 66 of the second upper major flap 29 abuts the second corner panel 26 when the box is in its erected, closed configuration.

Having the first section 62 of the first upper major flap 28 abut the first corner panel 25 and the first section 66 of the second upper major flap 29 abut the second corner panel 26 when the box is in its erected, closed configuration provides a stable box, i.e. shifting of the front and back panel, the side panels and the corner panels relative to each other is avoided.

The sum of the first angle ($\alpha$1) and the third angle ($\alpha$3) is between 240° and 300°, preferably between 250° and 290°, more preferably between 260° and 280°, and even more preferably 270°, and the sum of the second angle ($\alpha$2) and the fourth angle ($\alpha$4) is between 240° and 300°, preferably between 250° and 290°, more preferably between 260° and 280°, and even more preferably 270°.

As is shown in the Figures, in the box, a corner is formed where the first side edge 60 of the first upper major flap 28 coincides with the end edge 85 of the first upper major flap 28. This corner is on the top panel and spaced inwardly away from the fourth upper fold line 45 by at least 10 mm when the box is in its erected, closed configuration.

Moreover, in the box a corner is formed where the first side edge 64 of the second upper major flap 29 coincides with the end edge 86 of the second upper major flap 29. This corner is on the top panel and spaced inwardly away from the third upper fold line 44 by at least 10 mm, or by at least 15 mm, or by at least 20 mm when the box is in its erected, closed configuration. The corner may not be spaced inwardly away from the third upper fold line 44 by more than 80 mm, or by more than 70 mm, or by more than 60 mm.

Thereby, the first side edge of the first upper major flap, the first side edge of the second upper major flap as well as the corners formed as described in the previous two paragraphs cannot be easily folded over the third and fourth upper fold line, respectively, protecting the upper major flaps from being damaged when the box is closed, thereby contributing to the integrity of the closed box. Also, such configuration provides a box with an appearance of higher quality. If the inward spacing becomes too large, such as larger than 80 mm, the overall box stability may suffer in that a relatively large area of the first and second upper minor flaps are not overlapped and covered by the first and second upper major flaps.

In the box, a corner may be formed where the second side edge 61 of the first upper major flap 28 and the end edge 85 of the first upper major flap 28 coincide. This the corner may also coincide with the corner that is formed where the first side edge 64 of the second upper major flap 29 coincides with the end edge 86 of the second upper major flap 29 when the box is in its erected, closed configuration.

In the box, a further corner may be formed where the second side edge 65 of the second upper major flap 29 and the end edge 86 of the second upper major flap 29 coincide. This corner may also coincide with the corner that is formed where the first side edge 60 of the first upper major flap 28 coincides with the end edge 85 of the first upper major flap 28 when the box is in its erected, closed configuration.

Such coinciding of the corners further can further reduce the risk of damage to the side edges of the first and second upper major flaps. Moreover, Moreover, if the corners coincide, this provides a clear visual cue that the alignment of the box is correctly executed, hence enabling a fast and reliable folding and sealing process (especially if a worker is tasked to erect and seal the boxes), driving a consistent quality appearance, and reduced risk of wrongly configured boxes having poorer stability.

The first side edge 60 of the first upper major flap 28 may comprise a third section 80 and a fourth section 81. The third section 80 may be provided in between the first upper fold line 42 and the fourth section 81. The third section 80 may be perpendicular to the first upper fold line 42. The fourth section 81 may transition such that the corner, where the first side edge 60 and the end edge 85 coincide, also coincides with the second section 67 of the second side edge 65 of the second upper major flap 29 when the box is in its erected, closed configuration.

Likewise, the first side edge 64 of the second upper major flap 29 may comprise a third section 82 and a fourth section 83. The third section 82 may be provided in between the second upper fold line 43 and the fourth section 83. The third section 82 may be perpendicular to the second upper fold line 43. The fourth section 83 may transition such that the corner, where the first side edge 64 and the end edge 86 coincide, also coincides with the second section 63 of the first side edge 60 of the first upper major flap 28 when the box is in its erected, closed configuration.

As illustrated in FIG. 5, in the box, a fifth angle ($\alpha$5) may be formed between the first side panel 23 and the first corner panel 25 when the box is in its erected configuration. The fifth angle ($\alpha$5) is determined inside the box, i.e. between the surfaces of the first side panel 23 and the first corner panel 25, which face towards the interior of the erected box. The fifth angle ($\alpha$5) is equal to the first angle ($\alpha$1). Furthermore, a sixth angle ($\alpha$6) is formed between the front panel 21 and the first corner panel 25 when the box is in its erected configuration. The sixth angle ($\alpha$6) is also determined inside the box, i.e. between the surfaces of the front panel 21 and the first corner panel 25, which face towards the interior of the erected box. The sixth angle ($\alpha$6) is equal to the third angle ($\alpha$3).

Moreover, a seventh angle ($\alpha$7) is formed between the second side panel 24 and the second corner panel 26 when the box is in its erected configuration, The seventh angle ($\alpha$7) is determined inside the box, i.e. between the surfaces of the second side panel 24 and the second corner panel 26, which face towards the interior of the erected box. The seventh angle ($\alpha$7) is equal to the second angle ($\alpha$2). An eighth angle ($\alpha$8) is formed between the back panel 22 and the second corner panel 26 when the box is in its erected configuration. The eighth angle ($\alpha$8) is determined inside the box, i.e. between the surfaces of the back panel 22 and the second corner panel 26, which face towards the interior of the erected box. The eighth angle ($\alpha$8) is equal to the fourth angle ($\alpha$4).

Hence, when each of the first, second, third and fourth angle is 135° the front panel and the first corner panel, the first side panel and the first corner panel, the back panel and the first second corner panel, as well as the second side panel and the second corner panel, respectively, each form a 45° angel to each other (measured inside the erected box). At the same time, the front panel and second side panel and well as the back panel and the first side panel, respectively, may form a right angle (i.e. 90°) to each other, as measured inside the erected box.

The second section 55 of the first upper minor flap 30 may be provided perpendicular to the third upper fold line 44, and the second section 59 of the second upper minor flap 31 may be provided perpendicular to the fourth upper fold line 45. Likewise, the second section 63 of the first upper major flap 28 may be provided perpendicular to the first upper fold line 42, and the second section 67 of the second upper major flap 29 may be provided perpendicular to the second upper fold line 43.

The front panel 21 and the back panel 22 of the box may be parallel to each other when the box is in its erected configuration. The first and second side panels 23, 24 may be parallel to each other when the box is in its erected configuration. The first and second corner panels 25, 26 may be parallel to each other when the box is in its erected configuration.

The front and back panel 21, 22 may be wider than the first and second side panels 23, 24. The first and second side panels 23, 24 may be wider than the first and second corner panels 25. The width of the front panel extends parallel to the first upper fold line, the width of the back panel extends parallel to the second upper fold line. The width of the first side panel extends parallel to the third upper fold line and the width of the second side panel extends parallel to the fourth upper fold line. The width of the first corner panels extends along the shortest path from the front panel to the first side panel and the width of the second corner panel extends along the shortest path from the back panel to the second side panel.

The width of the front panel may be the same as the width of the back panel, the width of the first side panel may be the same as the width of the second side panel, and the width of the first corner panel may be the same as the width of the second corner panel.

The width of the front and back panel may be at least 1.3 times, or at least 1.5 times, or at least 1.8 times, or at least 2 times the width of the first and second side panel. The width of the first and second side panel may be at least 2 times, or at least 3 times, or at least 4 times the width of the first and second corner panel.

The height (extending perpendicular to the width) may be the same for front and back panel, the first and second side panel and the first and second corner panel.

The box may be formed from a continuous blank of foldable sheet material. The foldable sheet material may be cardboard or corrugated cardboard. For larger boxes, corrugated cardboard may be preferred, as it may provide a more stable material. Generally, it has been found that due to the two chamfered corners, the stability of the box can be improved versus a box having four rectangular corners, i.e. the box is more resistant to deformation or even collapse upon stacking multiple boxes on one another. Obviously, the absolute basis weight of the cardboard or corrugated cardboard will depend on the size and (weight of) the content of the box, however, it has been found that, assuming the same size and content of the box, lower basis weight foldable sheet materials can be used for the box of the present invention versus a rectangular box due to the chamfered corners. Thus, the box of the present invention is relatively cost-efficient and sustainable (thinner, i.e. overall less foldable sheet material is needed). The box may further comprise an overlap panel 27. The overlap panel may be provided anyway within or between the front and back, first and second side panels or first and second corner panels. Preferably, the overlap panel 27 may either adjoin the first side panel 23 and at least partially overlaps with and be attached to the first corner panel 25, or the overlap panel 27 may adjoin the second side panel 24 and at least partially overlapping with and attached to the second corner panel 26.

By providing the overlap panel in such position, the stability of the corner panel where the overlap panel is provided, can be improved. The top panel of the box may be sealed, e.g. by applying a tape 200 across the top panel, as exemplified in FIGS. 2 and 6. As shown in FIG. 6, the tape 200 may extend from the first side panel 23 towards the second side panel 24, along and over the end edges 85, 86 of the first and second upper major flap 28, 29. If the tape 200 extends beyond the top panel across the third and fourth upper fold line 44, 45 onto the first and second side panels 23, 24, forces are typically applied on the first and second side panel 23, 24 for attaching the tape 200 in these panels, which press the first and second side panel 23, 24 towards the interior of the box. The risk of possible deformation may be reduced if the overlap panel 27 is facing inwardly (i.e. towards the interior of the box) and the corner panel is facing outwardly. That way, the corner panel is supported by the overlap panel as a force is applied to the corner panel (via the side panel) upon application of the tape.

Alternatively to using a tape, the top panel of the box may also be sealed by application of adhesive (i.e. adhesive that is not comprised on a surface of a tape). For example, a hot melt adhesive can be used. The adhesive may be applied between the first and second upper minor flaps 30, 31 and the first and second upper major flaps 28, 29. The first and second upper minor flaps may each have an outwardly facing surface (i.e. a surface facing to the outside of the box) and may each have an opposing inwardly facing surface facing (i.e. a surface facing towards the inside of the box) when the box is in its erected, closed configuration. Similarly, the first and second upper major flaps may each have an outwardly facing surface (i.e. a surface facing to the outside of the box) and may each have an opposing inwardly facing surface facing (i.e. a surface facing towards the inside of the box) when the box is in its erected, closed configuration. In the closed box, the outwardly facing surfaces of the first and second upper minor flaps are in contact with the inwardly facing surfaces of the first and second upper major flaps. Adhesive, such as hot melt adhesive, may be applied between the outwardly facing surfaces of the first and second upper minor flaps and the inwardly facing surfaces of the first and second upper major flap to seal the box. The adhesive, such as hot melt adhesive, may be applied discontinuously.

For example, a small amount of adhesive may be applied locally (e.g. in an area of up to 20 $cm^2$, depending on the size of the box) between the first minor flap and the first major flap, between the first minor flap and the second major flap, between the second minor flap and the first major flap and between the second minor flap and the second major flap. The adhesive, such as hot melt adhesive, may cover from 2% to 20%, or from 2% to 15%, or from 2% to 10% of the areas by which the respective flaps overlap with each other.

Such sealing by adhesive, such as hot melt adhesive, may provide a closed box which is less prone to deformation. Given that the box of the present invention having two chamfered corners, is overall more prone to deform, sealing the box by adhesive, such as hot melt adhesive, may stabilize the box better than sealing with a tape by use of a mechanical tape applicator, which often applies substantial forces on the box during the tape application process. However, box stability also depends on the overall size of the box and the articles contained in the box.

The end edges 85, 86 of the first and second upper major flap 28, 29 may have a wavy shape (not shown). The end edge 85 of the first upper major flap 28 may have a first wavy shape and the end edge 86 of the second upper major flap 29 may have a second wavy shape complementary to the first wavy shape, such that the first wavy shape engages with the second wavy shape when the box is in its erected, closed configuration. These engaging wavy edges can help to improve the stability of the closed box, as the first and second upper major flaps are interlocked, i.e. they cannot shift relative to each other, even if they are not attached to each other, e.g. by an adhesive tape.

The erected box may further comprise a first vertical fold 36 line hingedly adjoining the front panel 21 to the first corner panel 25, a second vertical fold 37 line hingedly adjoining the front panel 21 to the second side panel 24, a third vertical fold 38 line hingedly adjoining the back panel 22 to the second corner panel 26, a fourth vertical fold line 39 hingedly adjoining the back panel 22 to the first side panel 23, a fifth vertical fold line 40 hingedly adjoining the first side panel to the first corner panel 44 or to an overlap panel 27, and a sixth vertical fold line 41 hingedly adjoining the second side panel 24 to the second corner panel 26 or to an overlap panel 27. The box can be flattened out such that the box is only folded along the second and fourth vertical fold line 27, 39, and all other fold lines are in their fully unfolded configuration.

Hence, by providing the box of the present invention having two chamfered corners, it is possible to fold the box such that it is completely flat, which provides substantial advantages versus e.g. a box having four chamfered corners, which can only be laid completely flat by pre-bending one vertical fold lines on one side edge of a corner panel by 180° while folding the vertical fold line on the respective other side edge of the corner panel at all. Such asymmetric pre-bending in the flat configuration applies to two of the corner panels (whereas the other two corner panels in a box with four chamfered corners are positioned within the plane of the flattened). The asymmetric pre-bending easily leads to an asymmetry in the erection process and thus to a box that is cannot be properly erected in a fast manner. As is often the case, a box may be manufactured in one site, including adjoining the overlap panel either adjoin the first side panel 23 and at least partially overlapping with and attached to the first corner panel 25, or adjoining the overlap panel 27 to the second side panel 24 and at least partially overlapping with and attached to the second corner panel 26. This pre-manufactured and assembled (i.e. attachment of the overlap panel) box may be transported to another site, where it is filled with items, such as absorbent articles. Being able to store and transport and provide the pre-manufactured and assembled boxes in a completely flat configuration is highly desirable, Moreover, such a box can be erected easily and quickly.

In the embodiment described above, the first and second corner panels 25, 26 are within the plane of the folded box when the box is in its flat, folded configuration, i.e. they are not involved in the folding, which is along the second and fourth vertical fold line 37, 39 and all other fold lines are in their fully unfolded configuration. It is desirable to provide the overlap panel 27 such that they can be attached to the first or second corner panel 25, 26. Thereby, like the first and second corner panels, also the area, where the overlap panel is provided, is within the plane of the folded box. Not having the overlap panel being directly adjacent the vertical fold lines that are folded when the box is flattened is beneficial as it eases the folding and also improves the stacking of the folded boxes on one another.

In the box, the first side edge 52 of the first upper minor flap 30 may comprise a third section 70 adjacent to the second section 55. The third section 70 may be provided at an angle to the second section 55 of less than 180° but more than 90°. Thereby, such the third section 70 does not abut the first upper fold line 42 when the box is in its erected, closed configuration.

The first side edge 56 of the second upper minor flap 31 may comprise a third section 71 adjacent to the second section 59. The third section 71 may be provided at an angle to the second section 59 of less than 180° but more than 90°. As a result, the third section 71 does not abut the second upper fold line 43 when the box is in its erected, closed configuration.

By not having the third sections 70, 71 of the first side edges 52, 56 of the first and second upper minor flaps 30, 31 abut the first and second upper fold line, respectively, easier folding down of the minor flaps is enabled. This is due to reduced friction between the first side edges 52, 56 with the surfaces of the first and second upper fold lines. Also, the box of the present invention is less sensitive to slight misalignment when folding and erecting the box from its flat configuration (wherein "flat configuration" here means that the overlap panel has already been attached to one of the first or second corner panels).

The third sections 70, 71 of the first side edges 52, 56 of the first and second upper minor flaps 30, 31 may be straight or curved (preferably they are not wavy). If they are curved, the angle of less than 180° and 90° is determined as the tangent of the curve.

The third sections 70, 71 of the first side edges 52, 56 of the first and second upper minor flaps 30, 31 may have the same length or be longer or shorter than the second sections 55, 59 of the first and second upper minor flaps first side edges 52, 56, depending on the overall shape and dimension of the box.

The second side edge 53 of the first upper minor flap 30 may comprise a fourth section 72 and a fifth section 73. The fourth section 72 may be provided in between the third upper fold line 44 and the fifth section 73). The fourth section 72 may abut the second upper fold line 43 when the box is in its erected, closed configuration. The fifth section 73 may be provided at an angle to the fourth section 72 of less than 180° but more than 90°, such that the fifth section 73 does not abut the second upper fold line (43) when the box is in its erected, closed configuration.

The second side edge 57 of the second upper minor flap 31 may comprise a fourth section 74 and a fifth section 75. The fourth section 74 may be provided in between the fourth upper fold line 45 and the fifth section 75. The fourth section 74 may abut the first upper fold line 42 when the box is in its erected, closed configuration. The fifth section 75 may be provided at an angle to the fourth section 74 of less than 180° but more than 90°, such that the fifth section 75 does not abut the first upper fold line 42 when the box is in its erected, closed configuration.

By having the fourth sections 72, 74 of the first and second upper minor flaps 30, 31 abut the second upper fold line 43 and the first upper fold line 42, respectively, the stability of the closed box is improved. The form of the box cannot be easily deformed, because the position of the front and back panel, the side panels and the corner panels relative to each other cannot be easily shifted. This is obtained without providing any additional flaps to the top panel which would need to be folded and processed in addition to the major and minor flaps.

Overall, by providing stability to the box with only four flaps (namely two major and two minor flaps) in each of the top and bottom panel, the box can be quickly and efficiently closed without the need to handle plenty of flaps and pieces.

By not having the fifth sections 73, 75 of the second side edges 53, 57 of the first and second upper minor flaps 30, 31 abut the first and second upper fold line 42, 43, respectively, easier folding down of the minor flaps is enabled. This is due to reduced friction between the second side edges 53, 57 with the surfaces of the first and second upper fold lines. The configuration also makes the box less sensitive to misalignment during erecting and folding.

The fifth sections 73, 75 of the second side edges 53, 57 of the first and second upper minor flaps 30, 31 may be straight or curved (preferably they are not wavy). If they are curved, the angle of less than 180° and 90° is determined as the tangent of the curve.

The third sections 70, 71 of the first side edges 52, 56 of the first and second upper minor flaps 30, 31 may have the same length or be longer or shorter than the second sections 55, 59 of the first and second upper minor flaps first side edges 52, 56, depending on the overall shape and dimension of the box.

The fourth section 72 of the second side edge 53 of the first upper minor flap 30 may be perpendicular to the third upper fold line 44. The fourth section 74 of the second side edge 57 of the second upper minor flap 31 may be perpendicular to the fourth upper fold line 45.

When the box is in its closed configuration, the bottom panel of the box may be fully closed, and the top panel may have a central open window. In the open window area, none of the upper major and minor flaps 28, 29, 30, 31 are provided. Such configuration can be obtained by having shorter upper major and/or minor flaps. Alternatively, when the box is in its closed configuration, the top panel of the box may be fully closed, and the bottom panel may have a central open window area. In the open window area, if provided in the top panel, none of the upper major and minor flaps 28, 29, 30, 31 are provided. If the open window area is provided in the bottom panel, none of the lower major and minor flaps 32, 33, 34, 35 are provided in the open window area. As said above, the terms "top panel" and "bottom panel" are not intended to limit the box to a certain orientation and position to the extent that the box can also be placed on a supporting surface with its top panel.

Providing the box with a central open window area in the top and/or bottom panel allows to reduce the amount of material needed for the box. Also, it may be beneficial if the contents of the box can be easily inspected (to some degree) without opening the box. The size of the open window area may be such that items within the box cannot fall out of their own motion, i.e. they do not fit through the open window area.

The box may have one or more (e.g. two) handles to enable convenient transport. This may be especially useful for relatively large boxes and/or boxes containing relatively heavy items.

A first handle 50 may be provided in the second side panel and a first handle 51 may be provided in the first side panel, as exemplified in FIGS. 1 to 6. The handles may be provided as cut-out sections to allow gripping the box by sliding one or more fingers of one hand through the first cut-out sections and sliding one or more fingers of the other hand through the second cut-out section. The cut-out is thus desirably large enough to allow one or more fingers to conveniently slide through. The cut-out sections may take an elongate shape with their larger dimension being provided essentially parallel to the second and fourth upper fold line 43, 45, respectively. The cut-out sections may be closer to the second and fourth upper fold line 43, 45 than to the second and fourth upper fold line 47, 49.

Figure 8:
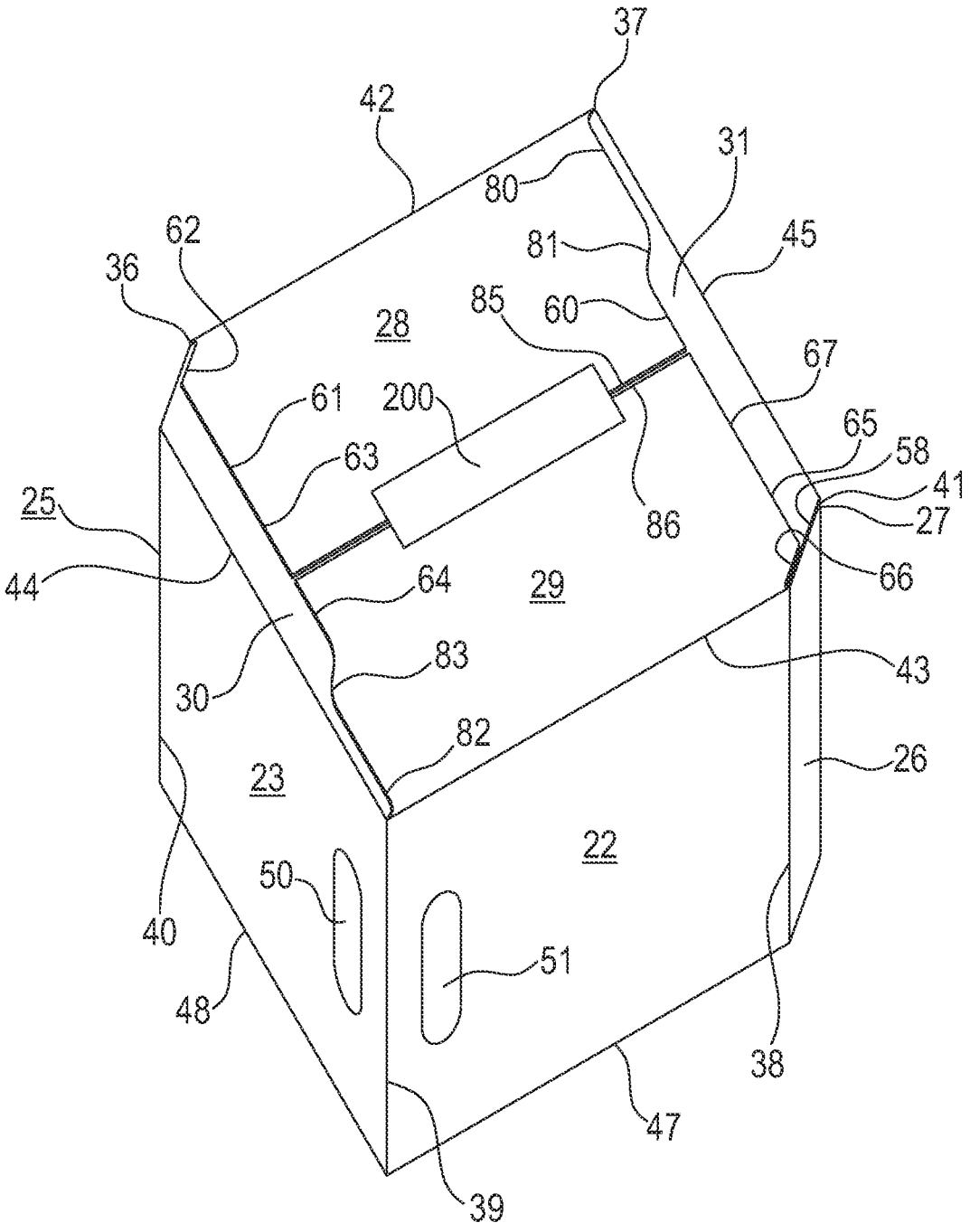
FIG. 8 shows the box of FIG. 7 in its erected, closed configuration, sealed with a tape.

Alternatively or in addition, as shown in FIGS. 7 and 8, a cut-out section 50 may be provided in the first side panel 23 and another cut-out section 51 may be provided in the back panel 22. Both cut-out sections may be adjacent to the fourth vertical fold line 39. The cut-out sections may have a rectangular, circular or elliptical shape. If the cut-out sections have an elongated shape (i.e. non-square and non-circular), their largest diameter may be essentially parallel to the fourth vertical fold line. A person may slide one or more fingers of one hand through both cut-out sections, thus basically gripping the box around the corner formed at the fourth vertical fold line. By doing so, the box can be gripped and carried with one hand only. Also, by holding/carrying the box with one hand such that the box hangs downward, one of the two chamfered corners will typically be positioned such, that the chamfered corner (i.e. not one of the rectangular corners) is close to and contacting the body, such as the legs. Thereby, carrying the box can be done more conveniently. For enabling convenient gripping, the box by sliding one or more fingers of one hand through both cut-out sections, the cut-out sections should be provided at an appropriate distance away from the fourth vertical fold line. For example, each cut-out section should be from 20 mm to 40 mm, or from 25 mm to 35 mm away from the fourth vertical fold line. By providing the cut-out sections too close to the fourth vertical fold line may decrease the stabilize of the box, whereas providing the cut-out sections too far away from the fourth vertical fold line may make it difficult to properly grip the box.

Alternatively or in addition to the cut-out section provided in the first side panel 23 and in the back panel 22, as described in the previous paragraph, cut-out sections may be provided in the second side panel 24 and the front panel 21. Both cut-out sections may be adjacent to the second vertical fold line 37. The cut-out sections may have a rectangular, circular or elliptical shape. If the cut-out sections have an elongated shape (i.e. non-square and non-circular), their largest diameter may be essentially parallel to the fourth vertical fold line. For enabling convenient gripping, the box by sliding one or more fingers of one hand through both cut-out sections, the cut-out sections should be provided at an appropriate distance away from the second vertical fold line. For example, each cut-out section should be from 20 mm to 40 mm, or from 25 mm to 35 mm away from the second vertical fold line. By providing the cut-out sections too close to the second vertical fold line may decrease the stabilize of the box, whereas providing the cut-out sections too far away from the second vertical fold line may make it difficult to properly grip the box.

Alternatively or in addition to the above, cut-out sections may also be provided in the top panel. For example, one cut-out section may be provided adjacent the end edge 85 of the first upper major panel 28 and another cut-out section may be provided adjacent the end edge 86 of the second upper major panel 29. Such cut-out sections may be provided half-way along the length of the end edges 85, 86 of the first and second major panel 28, 29 and the first and second upper minor panel 30, 31 are dimensioned such that they do not overlap with the cut-out sections provided in the first and second upper major panel 28, 29 when the box is in its closed configuration.

Basically, the first and second lower minor flaps 34, 35 and the first and second lower major flaps 32, 33 which, in conjunction, form the bottom panel of the box may have the same configuration as the flaps which form the top panel and which are described supra. The benefits of the respective features are basically also the same for the bottom panel as for the top panel. In the following, and as shown in FIG. 1, it will be described how the lower major and minor flaps may be configured.

The first lower minor flap 34 may comprise a first side edge 152 and a second side edge 153. The first side edge 152 may be overlapped by the first lower major flap 32 when the bottom panel of the box is closed. The second side edge 153 may be overlapped by the second lower major flap 33 when the bottom panel of the box is closed.

The first side edge 152 of the first lower minor flap 34 may comprise a first section 154 and a second section 155. The first section 154 may be provided in between the third lower fold line 48 and the second section 155.

In the first lower minor flap 34, a ninth angle ($\alpha$9) of between 120° and 150°, preferably between 130° and 140°, more preferably between 134° and 136°, and even more preferably 135°, may be formed between the third lower fold line 48 and the first section 154 of the first side edge 152. The first section 154 of the first lower minor flap 34 may abut the first corner panel 25 when the box is in its erected, closed configuration. The second section 155 of the first lower minor flap 34 may abut the first lower fold line 46 when the box is in its erected, closed configuration.

The second lower minor flap 35 may comprise a first side edge 156 and a second side edge 157. The first side edge 156 may be overlapped by the second lower major flap 33 when the bottom panel of the box is closed. The second side edge 157 may be overlapped by the first lower major flap 32 when the bottom panel of the box is closed. The first side edge 156 of the second lower minor flap 35 may comprise a first section 158 and a second section 159. The first section 158 may be provided in between the fourth lower fold line 49 and the second section 159.

In the second lower minor flap 35, a tenth angle α10 of between 120° and 150°, preferably between 130° and 140°, more preferably between 134° and 136°, and even more preferably 135° may be formed between the fourth lower fold line 49 and the first section 158 of the first side edge 156. The first section 158 of the second lower minor flap 35 may abut the second corner panel 26 when the box is in its erected, closed configuration. The second section 159 of the second lower minor flap 35 may abut the second lower fold line 47 when the box is in its erected, closed configuration.

The first lower major flap 32 may comprise a first side edge 160 and a second side edge 161. The first side edge 160 may overlap the second lower minor flap 35 when the box is closed. The second side edge 161 may overlap the first lower minor flap 34 when the box is closed. The first lower major flap 32 may further comprise an end edge 185 extending between the first and second side edges 160, 161.

The second side edge 161 of the first lower major flap 32 may comprise a first section 162 and a second section 163. The first section 162 may be provided in between the first lower fold line 46 and the second section 163.

In the first lower major flap 32, a eleventh angle (α11) of between 120° and 150°, preferably between 130° and 140°, more preferably between 134° and 136°, and even more preferably 135°, may be formed between the first lower fold line 46 and the first section 162 of the second side edge 161. The first section 162 of the first lower major flap 32 may abut the first corner panel 25 when the box is in its erected, closed configuration.

The second lower major flap 33 may comprise a first side edge 164 and a second side edge 165. The first side edge 164 may overlap the first lower minor flap 34 when the box is closed, and the second side edge 165 may overlap the second lower minor flap 35 when the box is closed. The second lower major flap 33 may further comprise an end edge 188 extending between the first and second side edges 164, 165.

The second side edge 165 of the second lower major flap 33 may comprise a first section 166 and a second section 167. The first section 166 may be provided in between the second lower fold line 47 and the second section 167.

In the second lower major flap 33, a twelfth angle (α12) of between 120° and 150°, preferably between 130° and 140°, more preferably between 134° and 136°, and even more preferably 135° [spec: preferably 135° may be formed between the second lower fold line 47 and the first section 165 of the second side edge 165. The first section 166 of the second lower major flap 33 may abut the second corner panel 26 when the box is in its erected, closed configuration.

The sum of the ninth angle (α9) and the eleventh angle (α11) may be between 240° and 300°, preferably between 260° and 280°, more preferably 270°, and the sum of the tenth angle (α10) and the twelfth angle (α12) may be between 240° and 300°, preferably between 260° and 280°, more preferably 270°.

The end edge 185 of the first lower major flap 32 may have a first wavy shape and the end edge 186 of the second lower major flap 33 may have a second wavy shape. The second wavy shape may be complementary to the first wavy shape, such that the first wavy shape engages with the second wavy shape when the box is in its erected, closed configuration.

The second section 155 of the first lower minor flap 34 may be provided perpendicular to the third lower fold line 48 and the second section 159 of the second lower minor flap 35 may be provided perpendicular to the fourth lower fold line 49.

The second section 163 of the first lower major flap 32 may be provided perpendicular to the first lower fold line 46, and the second section 167 of the second lower major flap 33 may be provided perpendicular to the second lower fold line 47.

The first side edge 152 of the first lower minor flap 34 may comprise a third section 170 adjacent to its second section 155. The third section 170 may be provided at an angle to the second section 155 of less than 180° but more than 90°, such that the third section 170 does not abut the first lower fold line 48 when the box is in its erected, closed configuration. The first side edge 156 of the second lower minor flap 35 may comprise a third section 171 adjacent to its second section 159. The third section 171 may be provided at an angle to the second section 159 of less than 180° but more than 90°, such that the third section 171 does not abut the second lower fold line 47 when the box is in its erected, closed configuration.

The second side edge 153 of the first lower minor flap 34 may comprise a fourth section 172 and a fifth section 173. The fourth section 172 may be provided in between the third lower fold line 48 and the fifth section 173. The fourth section 172 may abut the second lower fold line 47 when the box is in its erected, closed configuration. The fifth section 173 may be provided at an angle to the fourth section 172 of less than 180° but more than 90°, such that the fifth section 173 does not abut the second lower fold line 47 when the box is in its erected, closed configuration.

The second side edge 157 of the second lower minor flap 35 may comprise a fourth section 174 and a fifth section 175. The fourth section 174 may be provided in between the fourth lower fold line 49 and the fifth section 175. The fourth section 174 may abut the first lower fold line 46 when the box is in its erected, closed configuration. The fifth section 175 may be provided at an angle to the fourth section 174 of less than 180° but more than 90°, such that the fifth section 175 does not abut the first lower fold line 46 when the box is in its erected, closed configuration.

The fourth section 172 of the second side edge 153 of the first lower minor flap 34 may be perpendicular to the third lower fold line 48. The fourth section 174 of the second side edge 157 of the second lower minor flap 35 may be perpendicular to the fourth lower fold line 49.

The first lower major flap 32 may comprise an end edge 185 extending between the first and second side edges 160, 161 and a corner may be formed where the second side edge 161 and the end edge 185 coincide. The corner may also coincide with the first side edge 164 of the second lower major flap 33 when the box is in its erected, closed configuration.

The second lower major flap 33 may comprise an end edge 186 extending between the first and second side edges 164, 165 and a corner may be formed where the second side edge 165 and the end edge 186 coincide. The corner may also coincide with first side edge 160 of the first lower major flap 32 when the box is in its erected, closed configuration.

The first side edge 160 of the first lower major flap 32 may comprise a third section 180 and a fourth section 181. The third section 180 may be provided in between the first lower fold line 46 and the fourth section 181. The third section 180 may be perpendicular to the first lower fold line 46 and the fourth section 181 may transition such that the corner, where the first side edge 160 and the end edge 185 coincide, may also coincide with the second section 167 of the second side edge 165 of the second lower major flap 33 when the box is in its erected, closed configuration.

The first side edge 164 of the second lower major flap 33 may comprise a third section 182 and a fourth section 183. The third section 182 may be provided in between the second lower fold line 47 and the fourth section 183. The third section 182 may be perpendicular to the second lower fold line 47 and the fourth section 183 may transition such that the corner, where the first side edge 164 and the end edge 186 coincide, may also coincide with the second section 163 of the second side edge 161 of the first lower major flap 32.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A box with two chamfered edges, the box comprising:

a front panel and a back panel, a first and a second side panel, a first and a second corner panel, wherein the first corner panel adjoins the front panel and the first side panel and extends intermediate the front panel and first side panel, and the second corner panel adjoins the back panel and the second side panel and extends intermediate the back panel and second side panel, the box further comprising:

a first upper major flap hingedly adjoined to the front panel along a first upper fold line, and a second upper major flap hingedly adjoined to the back panel along a second upper fold line, a first upper minor flap hingedly adjoined to the first side panel along a third upper fold line, and a second upper minor flap hingedly adjoined to the second side panel along a fourth upper fold line, the first and second upper major flap and the first and second upper minor flaps in conjunction forming a top panel of the box;

a first lower major flap hingedly adjoined to the front panel along a first lower fold line, and a second lower major flap hingedly adjoined to the back panel along a second lower fold line, a first lower minor flap hingedly adjoined to the first side panel along a third lower fold line, and a second lower minor flap hingedly adjoined to the second side panel along a fourth lower fold line, the first and second lower major flap and the first and second lower minor flaps in conjunction forming a bottom panel of the box, wherein the first upper minor flap comprises a first side edge and a second side edge, the first side edge being overlapped by the first upper major flap when the top panel of the box is closed, and the second side edge being overlapped by the second upper major flap when the top panel of the box is closed, the first side edge of the first upper minor flap comprising a first section and a second section, the first section being provided in between the third upper fold line and the second section, wherein, in the first upper minor flap, a first angle ($\alpha$1) of between 120° and 150° is formed between the third upper fold line and the first section of the first side edge, wherein the first section of the first upper minor flap abuts the first corner panel when the box is in its erected, closed configuration, and the second section of the first upper minor flap abuts the first upper fold line when the box is in its erected, closed configuration, wherein the second upper minor flap comprises a first side edge and a second side edge, the first side edge being overlapped by the second upper major flap when the top panel of the box is closed, and the second side edge being overlapped by the first upper major flap when the top panel of the box is closed, the first side edge of the second upper minor flap comprises a first section and a second section, the first section being provided in between the fourth upper fold line and the second section, wherein, in the second upper minor flap, a second angle ($\alpha$2) of between 120° and 150° is formed between the fourth upper fold line and the first section of the first side edge, wherein the first section of the second upper minor flap abuts the second corner panel when the box is in its erected, closed configuration, and the second section of the second upper minor flap abuts the second upper fold line when the box is in its erected, closed configuration, wherein the first upper major flap comprises a first side edge and a second side edge, the first side edge overlapping the second upper minor flap when the top panel of the box is closed, and the second side edge overlapping the first upper minor flap when the top panel of the box is closed, the first upper major flap further comprises an end edge extending between the first and second side edges, the second side edge of the first upper major flap comprises a first section and a second section, the first section being provided in between the first upper fold line and the second section, wherein, in the first upper major flap, a third angle ($\alpha$3) of between 120° and 150° is formed between the first upper fold line and the first section of the second side edge, wherein the first section of the first upper major flap abuts the first corner panel when the box is in its erected, closed configuration, wherein the second upper major flap comprises a first side edge and a second side edge, the first side edge overlapping the first upper minor flap when the top panel of the box is closed, and the second side edge overlapping the second upper minor flap when top panel of the box is closed, the second upper major flap further comprises an end edge extending between the first and second side edges, the second side edge of the second upper major flap comprises a first section and a second section, the first section being provided in between the second upper fold line and the second section, wherein, in the second upper major flap, a fourth angle (α4) of between 120° and 150° is formed between the second upper fold line and the first section of the second side edge, wherein the first section of the second upper major flap abuts the second corner panel when the box is in its erected, closed configuration, wherein the sum of the first angle (α1) and the third angle (α3) is between 240° and 300°, and the sum of the second angle (α2) and the fourth angle (α4) is between 240° and 300°, and wherein a corner is formed where the first side edge of the first upper major flap coincides with the end edge of the first upper major flap, wherein the corner is on the top panel and spaced inwardly away from the fourth upper fold line by at least 10 mm when the box is in its erected, closed configuration, wherein a corner is formed where the first side edge of the second upper major flap coincides with the end edge of the second upper major flap, wherein the corner is on the top panel and spaced inwardly away from the third upper fold line by at least 10 mm when the box is in its erected, closed configuration, and wherein the first side edge of the first upper minor flap comprises a third section adjacent to the second section, the third section being provided at an angle to the second section of less than 180° but more than 90°, such that the third section does not abut the first upper fold line when the box is in its erected, closed configuration, and wherein the first side edge of the second upper minor flap comprises a third section adjacent to the second section, the third section being provided at an angle to the second section of less than 180° but more than 90°, such that the third section does not abut the second upper fold line when the box is in its erected, closed configuration.

2. The box of claim 1, wherein a corner is formed where the second side edge of the first upper major flap and the end edge of the first upper major flap coincide, wherein the corner also coincides with the corner that is formed where the first side edge of the second upper major flap coincides with the end edge of the second upper major flap when the box is in its erected, closed configuration; and wherein a corner formed where the second side edge of the second upper major flap and the end edge of the second upper major flap coincide, wherein the corner also coincides with the corner that is formed where the first side edge of the first upper major flap coincides with the end edge of the first upper major flap when the box is in its erected, closed configuration.

3. The box of claim 1, wherein the first side edge of the first upper major flap comprises a third section and a fourth section, the third section being provided in between the first upper fold line and the fourth section, wherein the third section is perpendicular to the first upper fold line and the fourth section transitions such that the corner, where the first side edge and the end edge coincide, also coincides with the second section of the second side edge of the second upper major flap when the box is in its erected, closed configuration; and wherein, the first side edge of the second upper major flap comprises a third section and a fourth section, the third section being provided in between the second upper fold line and the fourth section, wherein the third section is perpendicular to the second upper fold line and the fourth section transitions such that the corner, where the first side edge and the end edge coincide, also coincides with the second section of the second side edge of the first upper major flap when the box is in its erected, closed configuration.

4. The box of claim 1, wherein the second section of the first upper minor flap is provided perpendicular to the third upper fold line, and the second section of the second upper minor flap is provided perpendicular to the fourth upper fold line.

5. The box of claim 1, wherein the second section of the first upper major flap is provided perpendicular to the first upper fold line, and the second section of the second upper major flap is provided perpendicular to the second upper fold line.

6. The box of claim 1, further comprising an overlap panel, the overlap panel either adjoining the first side panel and at least partially overlapping with and attached to the first corner panel or adjoining the second side panel and at least partially overlapping with and attached to the second corner panel.

7. The box of claim 1, wherein the box is formed of cardboard or corrugated cardboard.

8. The box of claim 1, wherein the end edge of the first upper major flap has a first wavy shape and the end edge of the second upper major flap has a second wavy shape complementary to the first wavy shape, such that the first wavy shape interlocks with the second wavy shape when the box is in its erected, closed configuration.

9. The box of claim 1, wherein a fifth angle (α5) is formed between the first side panel and the first corner panel when the box is in its erected configuration, wherein the fifth angle (α5) is equal to the first angle (α1), and wherein a sixth angle (α6) is formed between the front panel and the first corner panel when the box is in its erected configuration, wherein the sixth angle (α6) is the equal to the third angle (α3), the fifth and sixth angle (α5, α6) being measured inside the box.

10. The box of claim 1, wherein a seventh angle (α7) is formed between the second side panel and the second corner panel when the box is in its erected configuration, wherein the seventh angle (α7) is equal to the second angle (α2), and wherein an eighth angle (α8) is formed between the back panel and the second corner panel when the box is in its erected configuration, wherein the eighth angle (α8) is equal to the fourth angle (α4), the seventh and eighth angle being measured inside the box.

11. The box of claim 1, wherein the box further comprises:

a first vertical fold line hingedly adjoining the front panel to the first corner panel, a second vertical fold line hingedly adjoining the front panel to the second side panel, a third vertical fold line hingedly adjoining the back panel to the second corner panel, a fourth vertical fold line hingedly adjoining the back panel to the first side panel, a fifth vertical fold line hingedly adjoining the first side panel to the first corner panel or to an overlap panel, a sixth vertical fold line hingedly adjoining the second side panel to the second corner panel or to an overlap panel, wherein the box can be flattened out such that the box is only folded along the second and fourth vertical fold line and all other fold lines are in their fully unfolded configuration.

12. The box of claim 11, wherein the overlap panel is attached to the first or second corner panel.

13. The box of claim 1, wherein the second side edge of the first upper minor flap comprises a fourth section and a fifth section, the fourth section being provided in between the third upper fold line and the fifth section, wherein the fourth section abuts the second upper fold line when the box is in its erected, closed configuration; and wherein the fifth section is provided at an angle to the fourth section of less than 180° but more than 90°, such that the fifth section does not abut the second upper fold line when the box is in its erected, closed configuration; and wherein the second side edge of the second upper minor flap comprises a fourth section and a fifth section, the fourth section being provided in between the fourth upper fold line and the fifth section, wherein the fourth section abuts the first upper fold line when the box is in its erected, closed configuration; and wherein the fifth section is provided at an angle to the fourth section of less than 180° but more than 90°, such that the fifth section does not abut the first upper fold line when the box is in its erected, closed configuration.

14. The box of claim 13, wherein the fourth section of the second side edge of the first upper minor flap is perpendicular to the third upper fold line, and wherein the fourth section of the second side edge of the second upper minor flap is perpendicular to the fourth upper fold line.

15. The box of claim 1, wherein the bottom panel of the box is fully closed when the box is in its erected, closed configuration, and the top panel has a central open window area, where none of the upper major and minor flaps are provided.

16. The box of claim 1, wherein the first and second upper minor flaps each have an outwardly facing surface and an opposing inwardly facing surface facing when the box is in its erected, closed configuration, and the first and second upper major flaps each have an outwardly facing surface and an opposing inwardly facing surface facing when the box is in its erected, closed configuration, and wherein hot melt adhesive is applied discontinuously between the outwardly facing surfaces of the first and second upper minor flaps and the inwardly facing surfaces of the first and second upper major flaps to seal the box.

17. The box of claim 1, wherein a) a cut-out section is provided in the first side panel and another cut-out section is provided in the back panel, each cut-out section being positioned adjacent to the fourth vertical fold line to enable sliding one or more fingers of one hand through both cut-out sections to grip the box around the corner formed at the fourth vertical fold line; and/or b) a cut-out section is provided in the second side panel and another cut-out section is provided in the front panel, each cut-out section being positioned adjacent to the second vertical fold line to enable sliding one or more fingers of one hand through both cut-out sections to grip the box around the corner formed at the second vertical fold line.

* * * * *